US009388685B2

(12) United States Patent
Ravi et al.

(10) Patent No.: US 9,388,685 B2
(45) Date of Patent: Jul. 12, 2016

(54) DOWNHOLE FLUID TRACKING WITH DISTRIBUTED ACOUSTIC SENSING

(71) Applicant: Halliburton Energy Services, Inc., Duncan, OK (US)

(72) Inventors: Kris Ravi, Kingwood, TX (US); Etienne Samson, Cypress, TX (US); John L. Maida, Houston, TX (US); William John Hunter, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 674 days.

(21) Appl. No.: 13/726,054

(22) Filed: Dec. 22, 2012

(65) Prior Publication Data

US 2014/0180592 A1 Jun. 26, 2014

(51) Int. Cl.
*E21B 47/10* (2012.01)

(52) U.S. Cl.
CPC ..... *E21B 47/101* (2013.01)

(58) Field of Classification Search
CPC ..... E21B 47/00; E21B 47/0003; E21B 47/10; E21B 47/101; E21B 47/123; G01N 21/47; G01N 2021/4719
See application file for complete search history.

(56) References Cited

U.S. PATENT DOCUMENTS 7,282,093 B2 10/2007 Brothers et al.
7,284,611 B2 10/2007 Reddy et al.
7,294,194 B2 11/2007 Reddy et al.
7,424,914 B2 9/2008 Reddy et al.
7,441,600 B2 10/2008 Brothers et al.
7,482,309 B2 1/2009 Ravi et al.

(Continued)

FOREIGN PATENT DOCUMENTS

EP 2386881 11/2011
WO WO-2012/110762 8/2012

(Continued)

OTHER PUBLICATIONS

Frisch et al., Assessment of Foamed-Cement Slurries Using Conventional Cement Evaluation Logs and Improved Interpretation Methods, 1999, SPE 55649, 10 pp.*
Maida, John L., et al., "Downhole Species Selective Optical Fiber Sensor Systems and Methods", U.S. Appl. No. 13/253,788, filed Oct. 5, 2011, 23 pgs.

(Continued)

*Primary Examiner* — Toan Le
(74) *Attorney, Agent, or Firm* — Krueger Iselin LLP; John W. Wustenberg

(57) ABSTRACT

Various disclosed distributed acoustic sensing (DAS) based systems and methods include embodiments that process the DAS measurements to detect one or more contrasts in acoustic signatures associated with one or more fluids flowing along a tubing string, and determine positions of the one or more contrasts as a function of time. The detected contrasts may be changes in acoustic signatures arising from one or more of: turbulence, frictional noise, acoustic attenuation, acoustic coupling, resonance frequency, resonance damping, and active noise generation by entrained materials. At least some of the contrasts correspond to interfaces between different fluids such as those that might be pumped during a cementing operation. Certain other method embodiments include acquiring DAS measurements along a borehole, processing the measurements to detect one or more acoustic signature contrasts associated with interfaces between different fluids in the borehole, and responsively displaying a position of at least one of said interfaces.

20 Claims, 5 Drawing Sheets

(56) References Cited

U.S. PATENT DOCUMENTS

| | | | | |
|---|---|---|---|---|
| 7,488,705 | B2 | 2/2009 | Reddy et al. | |
| 7,493,968 | B2 | 2/2009 | Reddy et al. | |
| 7,543,642 | B2 | 6/2009 | Reddy et al. | |
| 7,645,817 | B2 | 1/2010 | Reddy et al. | |
| 7,749,942 | B2 | 7/2010 | Ravi et al. | |
| 7,878,245 | B2 | 2/2011 | Ravi et al. | |
| 7,913,757 | B2 | 3/2011 | Reddy et al. | |
| 8,135,541 | B2 | 3/2012 | Davis et al. | |
| 8,162,050 | B2 | 4/2012 | Roddy et al. | |
| 8,202,824 | B2 | 6/2012 | Reddy et al. | |
| 8,291,975 | B2 | 10/2012 | Roddy et al. | |
| 8,316,936 | B2 | 11/2012 | Roddy et al. | |
| 2011/0088462 | A1 * | 4/2011 | Samson et al. | 73/152.18 |
| 2011/0090496 | A1 | 4/2011 | Samson et al. | |
| 2011/0116099 | A1 | 5/2011 | Spross et al. | |
| 2011/0192594 | A1 | 8/2011 | Roddy et al. | |
| 2011/0308788 | A1 | 12/2011 | Ravi et al. | |
| 2012/0013893 | A1 | 1/2012 | Maida et al. | |
| 2012/0014211 | A1 | 1/2012 | Maida et al. | |
| 2012/0061084 | A1 | 3/2012 | Sweatman et al. | |
| 2012/0126993 | A1 | 5/2012 | Samson et al. | |
| 2012/0147381 | A1 | 6/2012 | Leblanc et al. | |
| 2012/0192768 | A1 | 8/2012 | Ravi et al. | |
| 2012/0196777 | A1 | 8/2012 | Reddy et al. | |
| 2012/0205103 | A1 | 8/2012 | Ravi et al. | |
| 2012/0257475 | A1 | 10/2012 | Luscombe et al. | |
| 2012/0285682 | A1 | 11/2012 | Santra et al. | |
| 2012/0305248 | A1 | 12/2012 | Ravi et al. | |

FOREIGN PATENT DOCUMENTS

| | | |
|---|---|---|
| WO | WO-2012/150463 | 11/2012 |
| WO | WO-2014/099066 | 6/2014 |

OTHER PUBLICATIONS

Maida, John L., et al., "Optical Casing Collar Locator Systems and Methods", U.S. Appl. No. 13/226,578, filed Sep. 7, 2011, 30 pgs.

Samson, Etienne M., "Downhole Systems and Methods for Water Source Determination" U.S. Appl. No. 13/418,455, filed Mar. 13, 2012, 27 pgs.

Samson, Etienne M., et al., "Downhole Treatment Monitoring Systems and Methods Using Ion Selective Fiber Sensors", U.S. Appl. No. 13/717,979, filed Dec. 18, 2012, 23 pgs.

Samson, Etienne M., et al., "Remote Work Methods and Systems Using Nonlinear Light Conversion", U.S. Appl. No. 13/722,623, filed Dec. 20, 2021, 24 pgs.

Sharp, David P., et al., "Casing Collar Locator with Wireless Telemetry Support", U.S. Appl. No. 13/426,414, filed Mar. 21, 2012, 30 pgs.

Skinner, Neal G., et al., "Downhole Time Domain Reflectometry with Optical Components", U.S. Appl. No. 13/655,607, filed Oct. 19, 2012, 32 pgs.

"PCT International Preliminary Report on Patentability", dated Jul. 2, 2015, Appl No. PCT/US2013/061529, "Downhole Fluid Tracking with Distributed Acoustic Sensing," filed Sep. 25, 2013, 10 pgs.

"Search report and written opinion", dated Dec. 24, 2013, Appl No. PCT/US2013/061529, "Downhole Fluid Tracking with Distributed Acoustic Sensing," filed Sep. 25, 2013, 13 pgs.

"AU Examination Report", dated Nov. 9, 2015, "Downhole Fluid Tracking with Distributed Acoustic Sensing" filed Sep. 15, 2013, Appl No. 2013364277, 3 pgs.

Frisch, Gary J. et al., "Assessment of Foamed-Cement Slurries Using Conventional Cement Evaluation Logs and Improved Interpretation Methods", 1999, SPE 55649, 10 pgs.

* cited by examiner

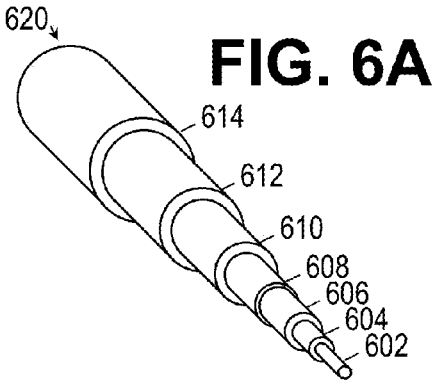
FIG. 6A
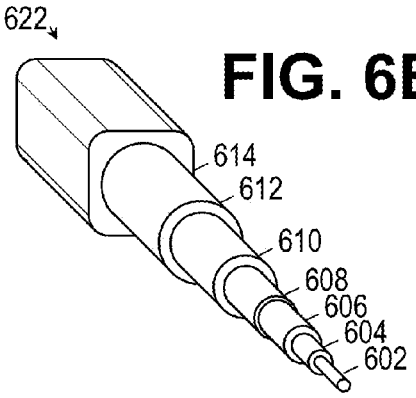
FIG. 6B
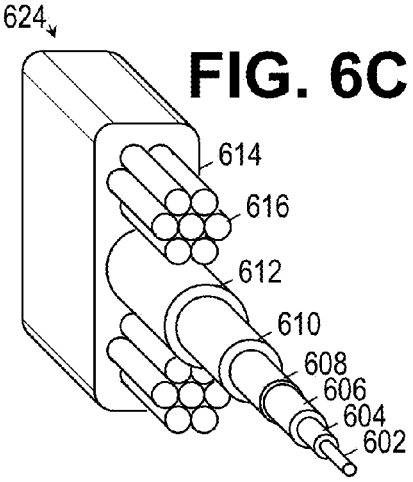
FIG. 6C
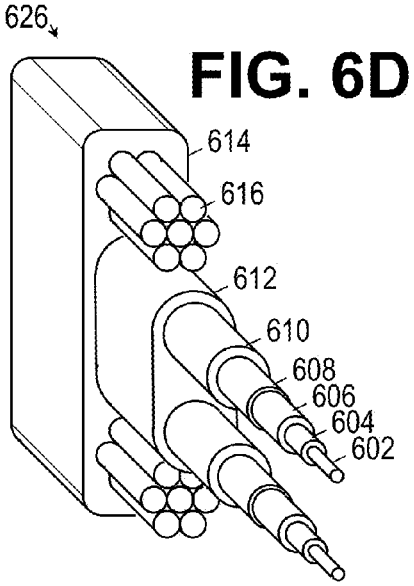
FIG. 6D
FIG. 7
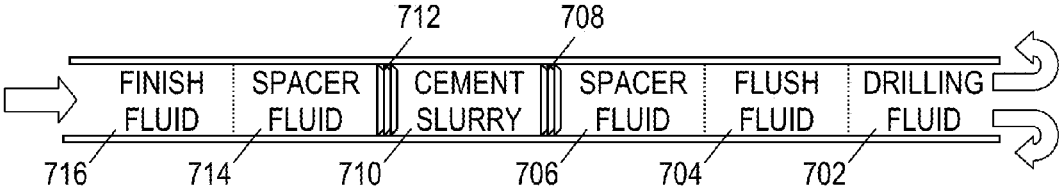

DOWNHOLE FLUID TRACKING WITH DISTRIBUTED ACOUSTIC SENSING

BACKGROUND

As wells are drilled to greater lengths and depths, it becomes necessary to provide a liner (usually casing or some other tubing string) to avoid undesirable fluid inflows or outflows and to prevent borehole collapse. The annular space between the borehole wall and the liner is usually filled with cement to reinforce structural integrity and to prevent fluid flows along the outside of the liner. If such fluid flows are not prevented, there is a loss of zonal isolation. Fluids from high-pressured formations can enter the borehole and travel along the outside of the liner to invade lower-pressured formations, or possibly to exit the borehole in a mixture that dilutes the desired production fluid. Results may include contamination of aquifers, damage to the hydrocarbon reservoir, and loss of well profitability.

The job of cementing the liner in place has several potential pitfalls. For example, as the borehole wall can be quite irregular, the volume of the annular space between the liner and the borehole wall is somewhat unpredictable. Moreover, there may be voids, fractures, and/or porous formations that allow cement slurry to escape from the borehole. Conversely, fluids (including gasses) can become trapped and unable to quickly escape from the annular space, thereby preventing the cement slurry from fully displacing such materials from the annular space. (Any such undisplaced fluids provide potential paths for fluid flow that can lead to a loss of zonal isolation.) Accordingly, the cementing crew may have difficulty predicting how much of the well will be successfully cemented by a given volume of cement slurry. Inaccurate estimates may lead to the use of too much or too little cement slurry and improper placement, any of which can reduce the utility and profitability of the well.

BRIEF DESCRIPTION OF THE DRAWINGS

Accordingly, there are disclosed in the drawings and the following description specific apparatus and method embodiments employing distributed acoustic sensing (DAS) to track and place cement slurry and other downhole fluids. In the drawings:

FIGS. 6A-6D show illustrative sensing fiber constructions.

FIG. 7 shows a sequence of fluids during an illustrative cementing job.

Figures 1, 2:
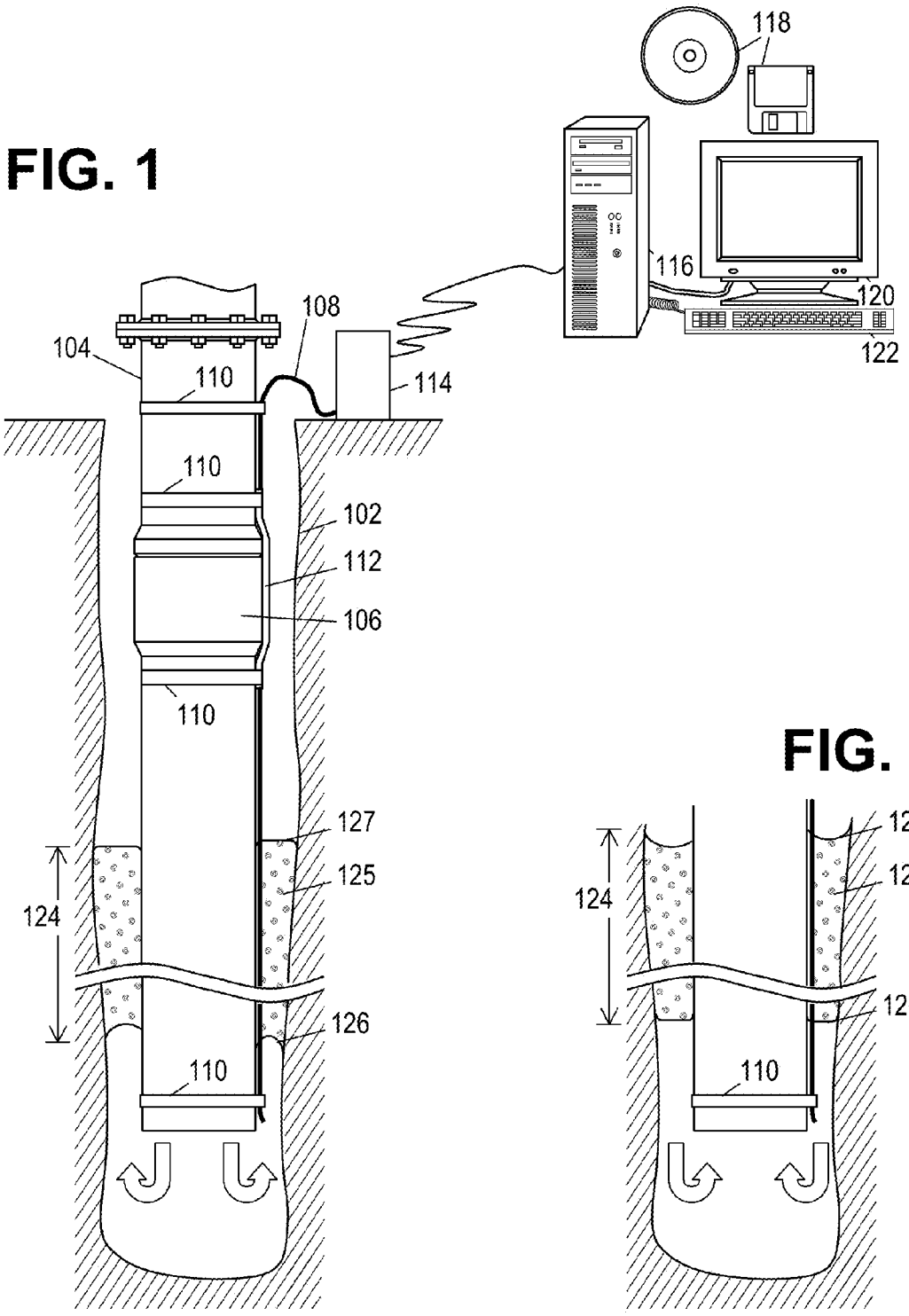
FIG. 1 shows an illustrative well with a DAS-based fluid tracking system.
FIG. 2 shows an illustrative cementing job variation using reverse circulation.

It should be understood, however, that the specific embodiments given in the drawings and detailed description thereto do not limit the disclosure, but on the contrary, they provide the foundation for one of ordinary skill to discern the alternative forms, equivalents, and modifications that are encompassed with the given embodiments by the scope of the appended claims.

NOMENCLATURE

The terms "including" and "comprising" are used in an open-ended fashion, and thus should be interpreted to mean "including, but not limited to . . . ". The term "couple" or "couples" is intended to mean either an indirect or direct electrical or mechanical connection. Thus, if a first device couples to a second device, that connection may be through a direct connection, or through an indirect connection via other devices and connections. Conversely, the term "connected" when unqualified should be interpreted to mean a direct connection. The term "fluid" as used herein includes materials having a liquid or gaseous state. As employed herein, the phrase "real time data processing" means that processing of the data occurs concurrently with the data acquisition process so that, e.g., results may be displayed or acted upon even as more data is being acquired.

DETAILED DESCRIPTION

The issues identified in the background are at least partly addressed by the various downhole fluid tracking systems and methods disclosed herein. At least some method embodiments include acquiring distributed acoustic sensing (DAS) measurements in a downhole environment and processing the measurements to detect one or more contrasts in acoustic signatures that are characteristic of different fluids (or in some cases, one fluid with modulated properties) flowing along a tubing string. The characteristic fluid signatures may arise, for example, from turbulence, friction, acoustic noise attenuation, acoustic noise coupling, resonance frequencies, resonance damping, and/or active noise generation. Contrasts in the acoustic signatures may indicate interfaces between different fluids, enabling these interfaces to be tracked as a function of time. When performed concurrently with pumping, such tracking enables cementing crews to provide accurate placement of cement slurries in the desired cementation zone. Such placement may be at least partly achieved by stopping the pumps when the cement slurry interfaces reach predetermined positions.

Fluid interface tracking further enables cross-sectional flow areas to be derived as a function of position and, if desired, converted into volumes such as the volume of cement slurry needed to fully occupy a cementation zone. In at least some cases, the necessary volume can be determined and/or adjusted during the pumping process.

Fluid interface tracking further enables rates of fluid loss or fluid gain as a function of position to be estimated and monitored. Corrective action (e.g., by adjusting pumping rates, inlet and outlet pressures, and fluid compositions) can be taken promptly to mitigate damage from unexpected or undesired fluid gains or losses.

Because at least some of the acoustic signature implementations do not actually require the monitored fluids to flow, at least some system and method embodiments are also applicable to monitoring substantially static downhole fluids. The acoustic signature contrasts can be tracked and used to display the positions of the downhole fluid interfaces.

The disclosed systems and methods are best understood in terms of the context in which they are employed. Accordingly, FIG. 1 shows an illustrative borehole 102 that has been drilled into the earth. Such boreholes 102 are routinely drilled to ten thousand feet or more in depth and can be steered horizontally for perhaps twice that distance. During the drilling process, a drilling crew circulates a drilling fluid to clean cuttings from the bit and carry them out of the borehole 102. In addition, the drilling fluid is normally formulated to have a desired density and weight to approximately balance the pressure of native fluids in the formation. Thus the drilling fluid itself can at least temporarily stabilize the borehole 102 and prevent blowouts.

To provide a more permanent solution, the drilling crew inserts a liner 104 (such as a casing string) into the borehole 102. A casing string liner 104 is normally formed from lengths of tubing joined by threaded tubing joints 106. The driller connects the tubing lengths together as the liner 104 is lowered into the borehole 102. During this process, the drilling crew can also attach a fiber optic cable 108 and/or an array of sensors to the exterior of the liner 104 with straps 110 or other mounting mechanisms such as those discussed further below. Because the tubing joints 106 have raised profiles, cable protectors 112 may optionally be employed to guide the cable 108 over the joints 106 and protect the cable 108 from getting pinched between the joint 106 and the borehole wall. The drilling crew can pause the lowering of the liner 104 at intervals to unreel more cable 108 and attach it to the liner 104 with straps 110 and cable protectors 112. In many cases it may be desirable to provide small diameter tubing to encase and protect the fiber optic cable 108. The cable 108 can be provided on the reel with flexible (but crush-resistant) small diameter tubing as armor, or can be seated within inflexible support tubing (e.g., via a slot) before being attached to the liner 104. Multiple fiber optic cables 108 can be deployed within the small diameter tubing for sensing different parameters and/or redundancy.

Once the liner 104 has been placed in the desired position, the cable(s) 108 can be trimmed and attached to a DAS measurement unit 114. The DAS measurement unit 114 supplies laser light pulses to the cable(s) 108 and analyzes the returned signal(s) to perform distributed sensing of vibration, pressure, strain, or other phenomena indicative of acoustic energy interactions with the optical fiber along the length of the liner 104. Fiber optic cables 108 that are specially configured to sense these parameters and which are suitable for use in harsh environments are commercially available. The light pulses from the DAS measurement unit 104 pass through the optical fiber and encounter one or more acoustic energy-dependent phenomena. Such phenomena may include spontaneous and/or stimulated Brillouin (gain/loss) backscatter, which are sensitive to strain in the fiber. Strain variations modulate the inelastic optical collisions within the fiber, giving a detectable Brillouin subcarrier optical frequency shift in the 9-11 GHz range which can be used for making DAS measurements.

Other phenomena useful for DAS measurements include incoherent and coherent Raleigh backscatter. In the coherent case, an optical laser source having a spectrum less than a few kHz wide transmits pulses of light along the optical fiber to generate reflected signals via "virtual mirrors" via elastic optical collisions with glass fiber media. These virtual mirrors cause detectable interferometric optical carrier phase changes as a function of dynamic strain (acoustic pressure and shear vibration). Commercially available single-pulse and dual-pulse DAS measurement units rely on this phenomenon.

By contrast, commercially available distributed temperature sensing (DTS) measurement units often rely on spontaneous and/or stimulated Raman backscatter. Due to temperature variations, such backscatter exhibits inelastic Stokes and Anti-Stokes wavelength bands above and below the laser probe wavelength. The Anti-Stokes wavelength light intensity level is a function of absolute temperature while Stokes wavelength light intensity is not as sensitive to temperature. The Anti-Stokes to Stokes intensity ratio is consequently a popular measure of absolute temperature in DTS systems.

To collect DAS measurements, the DAS measurement unit 114 may feed tens of thousands of laser pulses each second into the optical fiber and apply time gating to the reflected signals to collect acoustic intensity measurements at different points along the length of the cable 108. The DAS measurement unit 114 can process each measurement and combine it with other measurements for that point to obtain a time-sampled measurement of that acoustic intensity at each point. Though FIG. 1 shows a continuous cable 108 as the sensing element, alternative embodiments of the system may employ an array of spaced-apart fiber optic sensors that measure acoustic intensity data and communicate it to a measurement unit 114.

A general-purpose data processing system 116 can periodically retrieve the DAS measurements (i.e., acoustic intensity as a function of position) and establish a time record of those measurements. Software (represented by information storage media 118) runs on the general-purpose data processing system 116 to collect the DAS measurements and organize them in a file or database.

The software further responds to user input via a keyboard 122 or other input mechanism to display the DAS measurements as an image or movie on a monitor 120 or other output mechanism. As explained further below, certain patterns in the DAS measurements indicative of certain material properties in the environment around the fiber optic cable 108. The user may visually identify these patterns and determine and track the span 124 over which cement slurry 125 extends, including accurate determination of the cement slurry's leading and trailing fronts throughout the injection process, which in FIG. 1 become cement top 127 and bottom 126, respectively. Alternatively, or in addition, the software can provide real time data processing to identify these patterns and responsively track the fronts that define span 124. Any gaps or bubbles that form in the cement slurry 125 (e.g., as the result of trapped fluids or fluid inflow from the formation) may also be identifiable. Even in the absence of detectable gap formation, fluid losses and inflows can be detected via front motion that indicates volumetric losses or gains. Some software embodiments may provide an audible and/or visual alert to the user if patterns indicate the loss of cement slurry to the formation or the influx of formation fluids into the cement slurry.

To cement the liner 104, the drilling crew injects a cement slurry 125 into the annular space, typically by pumping the slurry through the liner 104 to the bottom of the borehole 102, which then forces the slurry to flow back up through the annular space around the liner 104. FIG. 2 illustrates a "reverse cementing" alternative, in which the slurry is pumped down through the annular space and displaced fluid escapes from the borehole 102 via the interior of liner 104. In reverse cementing, the correspondence of leading and trailing fronts is switched to cement bottom 126 and top 127, respectively.

It is expected that the software and/or the crew will be able to monitor the DAS measurements in real time to observe the acoustic energy profile (i.e., acoustic intensity as a function of depth) and to observe the evolution of the profile (i.e., the manner in which the profile changes as a function of time). From the evolution of the acoustic profile, the software and/or the user can track the current positions of the leading and trailing fluid fronts, compare pumping rates to front velocities to measure annular cross-sections, track front velocities over time to detect fluid inflows or losses, and act upon the information to correct fluid inflow/loss issues and achieve the desired cement placement.

There are several corrective actions that the crew might choose to take. If the crew determines that the span 124 is likely to be inadequate (e.g., due to fluid loss or an unexpectedly large annular volume), they can arrange to have more cement slurry injected into the annular space. Alternatively, if the span 124 is likely to be achieved more quickly than anticipated, the crew can reduce the amount of cement slurry to be injected into the annulus and, if necessary, employ an inner tubing string to circulate unneeded slurry out of the liner 104. If the crew detects fluid inflows, they can reduce the pumping rate and/or increase annular pressure (e.g., by closing a choke on an outlet from the annular region). Conversely, if they detect fluid loss, the crew can increase the pumping rate and/or reduce annular pressure. If such issues are detected sufficiently early (e.g., during a preflush), the crew can adjust the cement slurry composition to improve resistance to such issues.

Figure 3A:
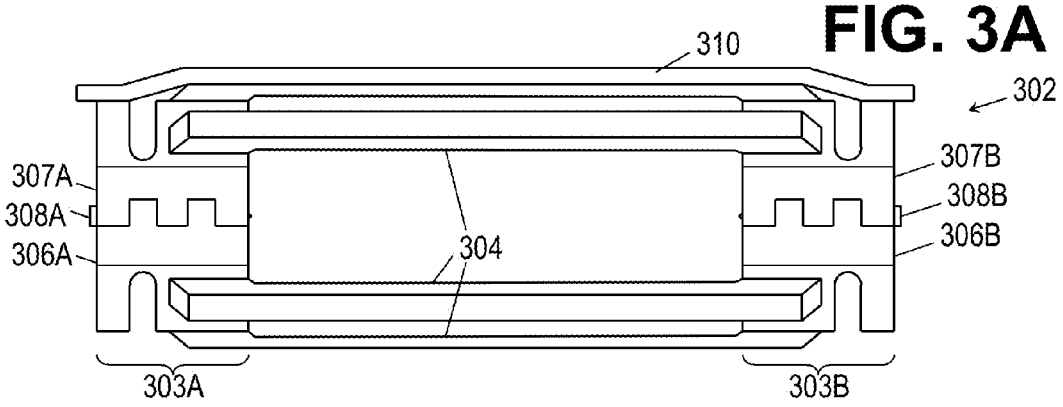
FIGS. 3A-3B show an illustrative mounting assembly.
Figure 3B:
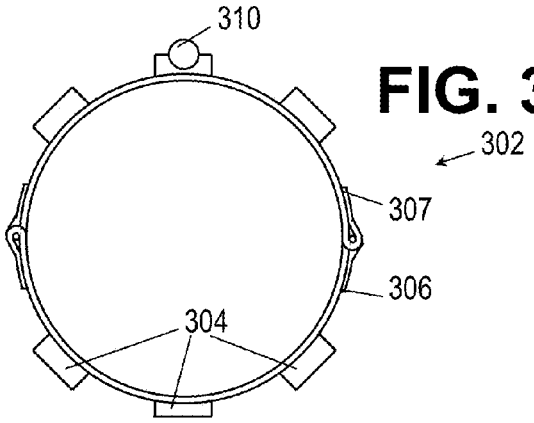

Fiber optic cable 108 may be attached to the liner 104 via straight linear, helical, or zigzag strapping mechanisms. FIGS. 3A and 3B show an illustrative straight strapping mechanism 302 having an upper collar 303A and a lower collar 303B joined by six ribs 304. The collars each have two halves 306, 307 joined by a hinge and a pin 308. A guide tube 310 runs along one of the ribs to hold and protect the cable 108. To attach the strapping mechanism 302 to the liner 104, the drilling crew opens the collars 303, closes them around the liner 104, and hammers the pins 308 into place. The cable 108 can then be threaded or slotted into the guide tube 310. The liner 104 is then lowered a suitable distance and the process repeated.

Figure 4:
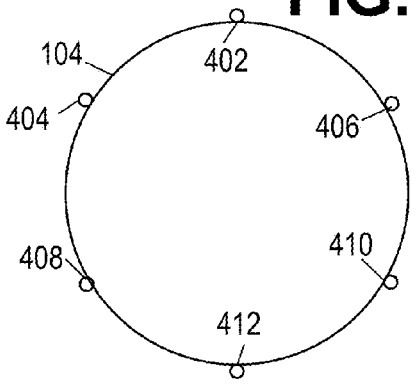
FIG. 4 shows an illustrative angular distribution of sensing fibers.

Some embodiments of the straight strapping mechanism can contain multiple cables 108 within the guide tube 310, and some embodiments include additional guide tubes along other ribs 304. FIG. 4 shows an illustrative arrangement of multiple cables 402-412 on the circumference of a liner 104. Taking cable 402 to be located at an azimuthal angle of 0°, the remaining cables 404-412 may be located at 60°, 120°, 180°, 240°, and 300°. Of course a greater or lesser number of cables can be provided, but this arrangement is expected to provide a fairly complete understanding of the flow profile in the annular region.

Figure 5:
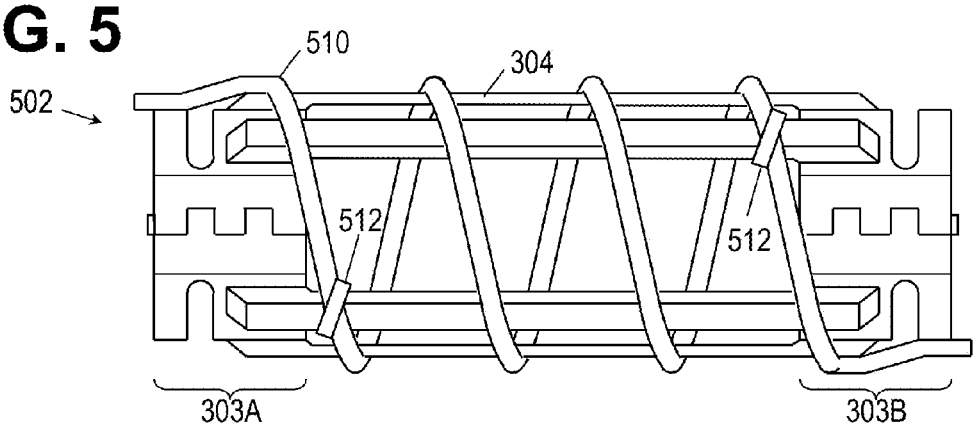
FIG. 5 shows an illustrative helical arrangement for a sensing fiber.

To obtain more complete measurements of the borehole fluid properties, the cable can be wound helically on the liner 104 rather than having it just run axially. FIG. 5 shows an alternative strapping mechanism that might be employed to provide such a helical winding. Strapping mechanism 502 includes two collars 303A, 303B joined by multiple ribs 304 that form a cage once the collars have been closed around the liner 104. The cable 510 is wound helically around the outside of the cage and secured in place by screw clamps 512. The cage serves to embed the cable 510 into the cement slurry or other fluid surrounding the liner 104.

Other mounting approaches can be employed to attach the cables to the liner 104. For example, casing string manufacturers now offer molded centralizers or standoffs on their liners. These take can the form of broad fins of material that are directly (e.g., covalently) bonded to the surface of the liner 104. Available materials include carbon fiber epoxy resins. Slots can be cut or formed into these standoffs to receive and secure the fiber optic cable(s) 108. In some applications, the liner 104 may be composed of a continuous composite tubing string with optical fibers embedded in the liner wall.

FIG. 6 shows a number of illustrative fiber optic cable constructions suitable for use in the contemplated system. Downhole fiber optic cables 108 are preferably designed to protect small optical fibers from corrosive wellbore fluids and elevated pressures while allowing for direct mechanical coupling (for strain or pressure measurements) or while allowing decoupling of the fibers from strain (for unstressed vibration/acoustic measurements). These cables may be populated with multimode and singlemode fiber varieties, although alternative embodiments can employ more exotic optical fiber waveguides (such as those from the "holey fiber" regime) for more enhanced supercontinuum and/or optically amplified backscatter measurements.

Each of the illustrated cables has one or more optical fiber cores 602 within cladding layers 604 having a higher refraction index to contain light within the core. A buffer layer 606, barrier layer 608, armor layer 610, inner jacket layer 612, and an outer jacket 614 may surround the core and cladding to provide strength and protection against damage from various dangers including moisture, hydrogen (or other chemical) invasion, and the physical abuse that may be expected to occur in a downhole environment. Illustrative cable 620 has a circular profile that provides the smallest cross section of the illustrated examples. Illustrative cable 622 has a square profile that may provide better mechanical contact and coupling with the outer surface of liner 104. Illustrative cables 624 and 626 have stranded steel wires 616 to provide increased tensile strength. Cable 626 carries multiple fibers 602 which can be configured for different measurements, redundant measurements, or cooperative operation. (As an example of cooperative operation, one fiber can be configured as a "optical pump" fiber that optically excites the other fiber in preparation for measurements via that other fiber.) Inner jacket 612 can be designed to provide rigid mechanical coupling between the fibers or to be compliant to avoid transmitting any strain from one fiber to the other.

Thus liners 104 with fiber optic cable(s) 108 embedded in the walls, wound around or attached to the exterior, or suspended in the annular space with ribs, cages, fins, or centralizers, have been described above. Also, as previously described, each fiber optic cable 108 is usable as a distributed acoustic sensor to monitor activity along the length of the borehole 102. The authors have determined that fluid fronts can be located and tracked with a DAS measurement unit 114 coupled to an optical fiber in the borehole 102.

As conceptually illustrated in FIG. 7, a typical cementing operation involves a sequence of fluids. The crew will vary the fluids and sequences depending on the individual circumstances associated with each job, so the following discussion should not be taken as limiting. We further note that FIG. 7 is not to scale, and in many cases the length of the fluid columns may be such that the liner 104 contains no more than two fluids at any given time. Normally each of the fluids is a liquid, but it is possible that one or more of them might be a gas.

FIG. 7 shows the following illustrative sequence:

1. drilling fluid 702
2. flush fluid 704
3. spacer fluid 706
4. cementing plug 708
5. cement slurry 710
6. cementing plug 712
7. spacer fluid 714
8. finish fluid 716

Drilling fluid 702 represents the fluid remaining in the borehole 102 as cementing operations are about to commence. Typically, drilling fluid 702 is a fluid used to maintain borehole integrity and clear drill cuttings during the drilling process. It is often a dense, oil-based fluid that, if not cleaned from the surfaces in the borehole 102, would likely inhibit cement bonding to the liner 104 and formation. A flush fluid 704 is cycled through the liner 104 and annulus to clean and treat the surfaces in the borehole 102 to promote adhesion to the cement slurry. A spacer fluid 706 serves to displace the preceding fluids and may be formulated to minimize mixing of itself or any preceding fluids with the cement slurry 710. In many cases, a single fluid can serve as both the flush fluid 704 and the spacer fluid 706.

As the cement slurry 710 travels into the well via liner 104, it may be kept separate from adjacent fluids by rubber cementing plugs 708, 712. The cementing plugs 708, 712 clean the interior of the liner 104 and prevent contamination of the cement for as long as possible. At the bottom of the liner 104, the cementing plugs 708, 712 are ruptured or bypassed, enabling the cement slurry 710 to be driven into the annular space around the liner 104. Thereafter, the spacer fluids 706, 714 serve to minimize mixing. The finish fluid 716 occupies the liner 104 as the cement slurry 710 cures.

Figure 8A:
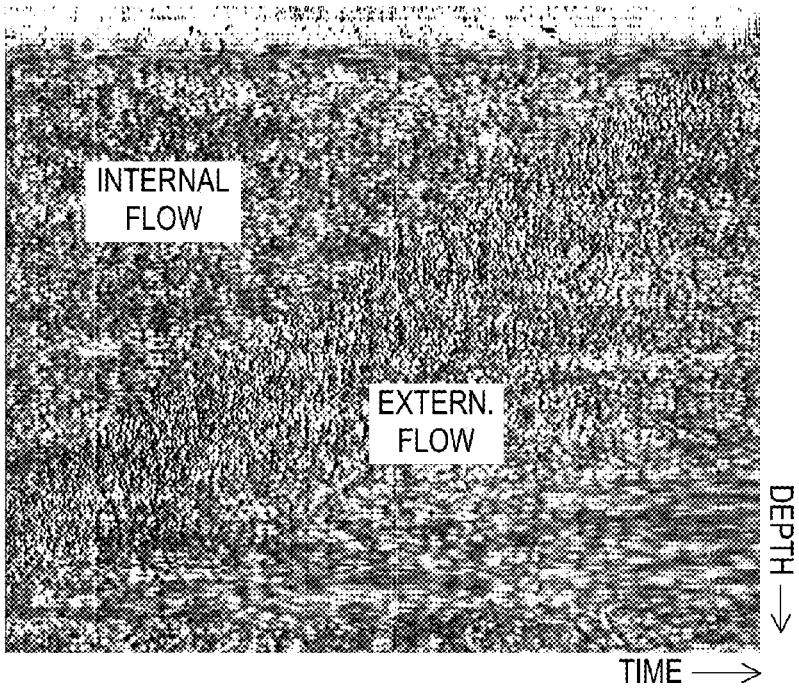
FIGS. 8A-8C show distributed fiber measurements during illustrative cementing jobs.
Figure 8B:
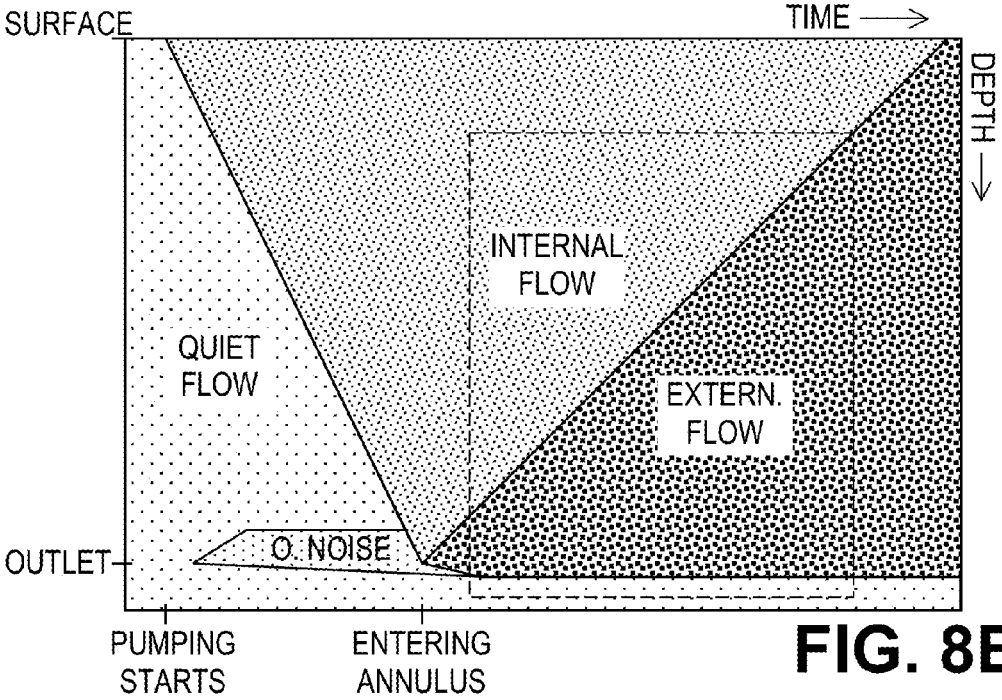
Figure 8C:
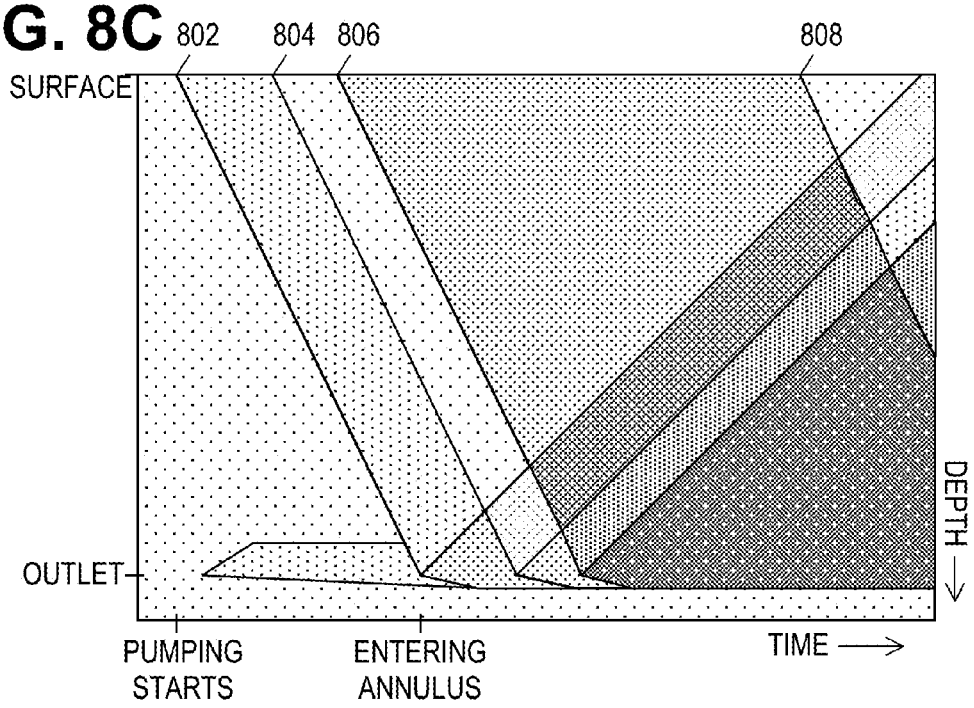

FIGS. 8A-8C show exemplary DAS measurements of illustrative cementing operations. The vertical axis represents depth or position along the borehole 102. The horizontal axis represents time. The figures represent the acoustic intensity measured at each position along the fiber optic cable 108 as a function of time.

FIG. 8A shows DAS measurements from an actual two-fluid test. Aside from a generally elevated level of acoustic intensity along the top of the figure (where the fiber optic cable 108 runs near the pump house), the figure shows largely random acoustic intensity variation. However, there is a sharp contrast in the nature of the random variation defined by the position of the fluid front. Specifically, as the displacing fluid (glycol) forces the displaced fluid (diesel) along the annulus, the displacing fluid makes contact with the fiber optic cable 108. The DAS measurements show a substantial and abruptly increased variation in the acoustic intensity measurements where this contact exists.

FIG. 8B schematically shows a larger context for the measurements of FIG. 8A. (The measurements of FIG. 8A are represented by the region in the dashed box.) Initially, along the length of the well, everything is quiet. As pumping starts, a displacing fluid is introduced, flowing down through the interior of the liner 104 until it reaches the outlet and returns to the surface via the annular region. The displaced fluid is forced ahead of the displacing fluid and exits through the annular region. As indicated by the region label "Quiet Flow", the flow of the displaced fluid in the experiment did not exhibit significant acoustic variation except in the outlet region (labeled "O. Noise") where turbulence-induced noise became evident shortly after pumping began. As indicated by the region labeled "Internal Flow", the flow of the displacing fluid through the liner 104 created a characteristic acoustic variation signature. As indicated by the region labeled "External Flow", the return flow of the displacing fluid through the annular region provided a second, distinguishable acoustic variation signature. The changes in signature are extremely well localized, enabling the fluid front to be tracked in real time as it propagates into the liner 104 and along the annular region.

There are multiple ways that a fluid flow can create a suitable signature for DAS detection, particularly when ambient noise or other acoustic energy sources are present. For example, a fluid flow may be designed with a high Reynolds number to assure turbulent flow. As another example, a fluid flow may suspend particles that rub on each other or external surfaces to generate frictional noise. As yet another example, a fluid flow may be formulated to attenuate (or fail to attenuate) acoustic energy propagating from external or ambient sources. (With appropriate dimensions and concentrations, entrained glass beads have been shown to provide excellent acoustic attenuation.) As a further example, a fluid flow may be provided with an acoustic impedance that promotes or inhibits coupling of acoustic energy to the fiber optic cable 108. As still yet another further example, a fluid flow may be given a density and/or viscosity to alter a resonance frequency of a surface or vibrating element. Still other examples include elements suspended in the fluid flow that actively generate acoustic energy by, e.g., cracking, popping, fizzing, etc., while flowing. Such acoustic energy generation could be caused via chemical reactions and/or the imposition of elevated temperatures, pressures, or other characteristic downhole conditions. Many of these ways can also serve for tracking and monitoring fluids that are not flowing.

While any or all of these ways can be used alone or in various combinations, the presently preferred approach provides for varying levels of turbulent flow. It is recognized further that turbulent flow can often be promoted with the use of certain features, e.g., constrictions, projections, edges, channels, fins, flags, streamers, roughened surfaces, etc. Such features may be provided at regular intervals along the borehole 102, preferably proximate to the fiber optic cable 108, both inside and outside the liner 104.

FIG. 8C is a representation of the measurements that are expected to be observable with a five-fluid sequence, e.g., drilling fluid, flush fluid, spacer fluid, cement slurry, and spacer fluid. Each is provided with a characteristic acoustic signature to enable tracking of the fluid fronts 802, 804, 806, 808. Fluid front 802 is the interface between the drilling fluid and the flush fluid, fluid front 804 is the interface between the flush fluid and the spacer fluid, fluid front 806 is the interface between the spacer fluid and the cement slurry, and fluid front 808 is the interface between the cement slurry and the second spacer fluid. With a constant pumping rate, each of the fluid fronts is expected to have a V-shape, with the descending arm of the V representing the front's position with respect to time as it travels via the interior of the liner 104, and the ascending arm of the V representing the front's position with respect to time as it travels through the annular region. In a reverse cementing operation, the arms would be reversed.

The cross-section of the annular region is usually larger than the interior cross-section of the liner 104, so the front travels faster in the interior than in the annular region. This relationship is reflected by the difference in slopes of the arms of the V. Where the cross-sections are known (e.g., for the liner interior, or for the annular region if a caliper log has been run on the borehole 102), the expected slopes are determinable from the pumping rate. Where such information is not available, the first fluid front may be tracked and combined with the pumping rate to obtain a cross-sectional area estimate.

Any deviation from the initial or predicted slope should be examined carefully. A gradually-increasing upward deviation of the slope may be indicative of fluid gains due to inflows of formation fluids. A gradually-worsening downward deviation of the slope may be indicative of fluid losses to the formation. A localized deviation (after which the slope returns to the expected value) may be indicative of a cavity or other unexpected error in the cross-sectional estimates for that region. The crew is able to recognize such issues during the pumping process and act to mitigate their effects.

The overlapping internal and external flows of fluids having different acoustic signatures may superimpose multiple V's to create a "checkerboard" or "basket weave" pattern in the DAS measurements. Nevertheless, each front is expected to be recognizable and separately trackable, particularly because the slopes associated with the fluid fronts' travel is predictable and should be consistent from front to front absent changes in the pumping rates. Any unexplained inconsistencies should be carefully examined as they may be indicative of changes in the borehole 102, e.g., fractures being created and opened by excessive pumping pressures. Such issues are preferably identified promptly to enable corrective action (e.g., reduction of the annular pressure) before excessive damage occurs.

Figure 9:
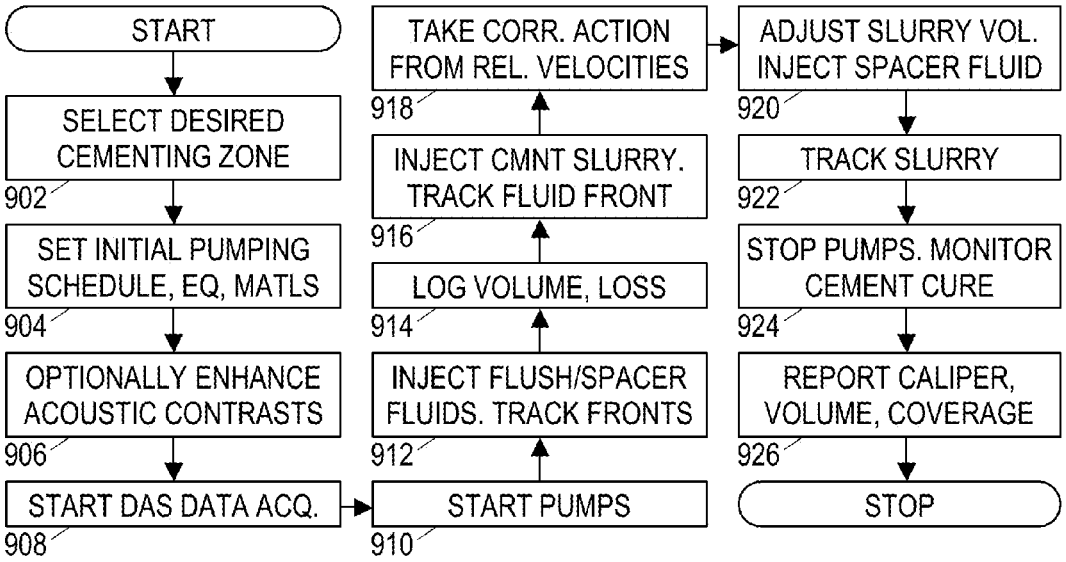
FIG. 9 is a flow diagram of an illustrative DAS-based cement slurry placement method.

FIG. 9 is a flow diagram of an illustrative DAS-based cement slurry placement method. It is assumed that the drilling has been (at least temporarily) suspended with liner 104 (e.g., a casing or tubing string) in the borehole 102 and equipped with a fiber optic cable 108 as described previously. Supplied with information about the well trajectory, tubing configuration, formation logs, etc., and beginning in block 902, the cementing crew determines which zone is to be cemented. Relying on personal knowledge and previous experience in the art, the crew formulates in block 904 an initial pumping schedule with a desired sequence of fluid volumes, flow rates, fluid properties, and inlet/outlet pressures. The crew secures the equipment and supplies needed for the initial pumping schedule with reasonable reserves for contingencies. In block 906, the crew may optionally enhance contrasts in the acoustic signatures of the adjacent fluids, e.g., by adjusting pre-mixed fluid properties. In alternative method embodiments, such enhancement can be performed with additives during the pumping process itself In block 908, the crew starts acquiring and monitoring distributed acoustic sensing (DAS) data via data processing system 116, and in block 910, starts the pumps. In block 912, the crew injects the spacer fluid and/or the flush fluid in accordance with the pumping schedule to displace the existing fluids and prepare the downhole surfaces for cementing. During the pumping process, system 116 detects and tracks the fluid fronts based on the DAS measurements as a function of time and position. Specifically, the DAS measurements can be time and space filtered (and optionally frequency filtered) to detect contrasts in the acoustic intensity (and/or acoustic intensity variation) indicative of fluid fronts. In block 914, the velocity of the fluid fronts can be combined with the pumping rate information to discern the differential volume (i.e., cross-sectional area) occupied by the fluid at each point along the flow path, and certain trends in the differential volume may be identified as tentatively indicating losses or gains in fluid volume.

In block 916, the crew begins injecting the cement slurry and tracking the fluid front as before. In block 918 the behaviors of the multiple fronts are compared to refine the estimated volumes and increase or decrease confidence in the tentatively identified issues. Corrective action may be taken to mitigate the issues and assure that the desired zonal coverage is achieved. For example, the pumping schedule may be adjusted to increase or reduce annular pressure to combat inflows or fluid losses, to adjust pumping rates or modify fluid properties for similar reasons. In block 920, the crew may further adjust the volume of the cement slurry to match the volume of the desired cementing zone, and adjust the volume of the second spacer fluid to ensure correct placement of the cement slurry.

In block 922, the crew monitors the fronts associated with the cement slurry. When the desired placement is reached in block 924, the crew halts the pumps and allows the cement slurry to harden and cure. The ability to track and assure accurate cement slurry placement may reduce the need for position adjustments as the slurry gels and begins to harden, which in turn reduces the risk of zonal isolation loss. Other potential tracking benefits include improved control over trapped annular pressure, improved placement relative to previous liners or liner hangers, avoidance of seabed mound formation around the well, and better cement shoe formation.

For monitoring the actual curing process, distributed temperature sensing (DTS) may be performed using the same fiber(s) used for DAS measurements. In block 926, the data processing system 116 generates a complete log of the DAS measurements, including the estimated volumes, borehole caliper, and cementing coverage.

The foregoing operations are described in an illustrative sequence for clarity, but it should be understood that many of the operations may be occurring concurrently and in various orders as demanded by the particular cementing job. For example, the reporting operation represented by block 926 may be performed continuously and concurrently with the other operations. The corrective operations and adjustments represented by blocks 918 and 922 may be accelerated or anticipated by adjustments made during earlier injection operations.

Numerous other variations and modifications will become apparent to those skilled in the art once the above disclosure is fully appreciated. For example, the acoustic signature of a given flow can be modulated (e.g., by modulating the addition of additives to the fluid) to create additional acoustic signature contrasts. Such modulation enables closer front spacing without modifying the other fluid effects, providing finer time resolution of downhole circumstances and greater confidence in the derived measurements. It is intended that the following claims be interpreted to embrace all such variations and modifications.

What is claimed is:

1. A method that comprises:

pumping different fluids along a circulation path that includes an annulus around a liner;

acquiring downhole distributed acoustic sensing (DAS) measurements;

processing the measurements to detect a contrast in acoustic signatures associated with an interface between the different fluids flowing along the circulation path;

determining a position of the interface as a function of time, wherein said determining is performed concurrently with said pumping; and displaying the position of the interface.

2. The method of claim 1, further comprising:

halting the pumping when the interface reaches a predetermined position, wherein at least one of the different fluids is a cement slurry.

3. The method of claim 1, further comprising:

deriving an annular cross-sectional flow area as a function of position based at least in part on the determined position as a function of time.

4. The method of claim 3, further comprising:

converting the annular cross-sectional flow area as a function of position into a volume for a cementation zone; and responsively pumping a cement slurry of said volume to the cementation zone.

5. The method of claim 1, further comprising:

deriving a rate of fluid loss or gain as a function of position based at least in part on the determined position as a function of time.

6. The method of claim 5, further comprising:

modifying at least one parameter while pumping to mitigate fluid loss or gain, the at least one parameter being in the set consisting of pumping rate, fluid composition, inlet pressure, and outlet pressure.

7. The method of claim 1, wherein the acoustic signature contrasts are created by changes in at least one of: acoustic attenuation, acoustic coupling, resonance frequency, resonance damping, and active noise generation.

8. A method that comprises:

pumping different fluids along a circulation path in a borehole;

acquiring distributed acoustic sensing (DAS) measurements along the borehole;

processing the measurements to detect acoustic signature contrasts associated with interfaces between the different fluids flowing along the borehole; and responsively displaying positions of the interfaces as the interfaces move along an interior of a liner and an annular space around the liner.

9. The method of claim 8, further comprising:

deriving a fluid loss or gain rate based at least in part on changes in said position as a function of time.

10. The method of claim 8, wherein the acoustic signature contrasts are created by changes in at least one of: acoustic attenuation, acoustic coupling, resonance frequency, resonance damping, and active noise generation.

11. A system that comprises:

a liner in a borehole, the liner having an optical fiber for distributed acoustic sensing (DAS) along the liner;

a DAS measurement unit coupled to the optical fiber to acquire DAS measurements; and a data processing system coupled to the DAS measurement unit, the data processing system:

operating on the measurements to detect contrasts in acoustic signatures associated with interfaces between different fluids flowing along an annular space around the liner;

determining position of the interfaces as a function of time; and displaying the position of the interfaces.

12. The system of claim 11, wherein the data processing system determines said position while the DAS measurement unit is acquiring DAS measurements.

13. The system of claim 11, wherein at least one of the different fluids is a cement slurry.

14. The system of claim 11, wherein the data processing system derives an annular cross-sectional flow area as a function of position based at least in part on the determined position as a function of time.

15. The system of claim 14, wherein the data processing system further converts the annular cross-sectional flow area as a function of position into a volume for a cementation zone.

16. The system of claim 11, wherein the data processing system derives a rate of fluid loss or gain as a function of position based at least in part on the determined position as a function of time.

17. The system of claim 11, wherein the acoustic signature contrasts are created by changes in at least one of: acoustic attenuation, acoustic coupling, resonance frequency, resonance damping, and active noise generation.

18. A system that comprises:

an optical fiber positioned on a liner in a borehole;

a distributed acoustic sensing (DAS) measurement unit coupled to the optical fiber to acquire DAS measurements; and a data processing system coupled to the DAS measurement unit, the data processing system:

operating on the measurements to detect an acoustic signature contrast associated with an interface between different fluids flowing along the borehole, and displaying a position of the interface as the interface moves along an interior of the liner and an annular space around the liner.

19. The system of claim 18, wherein the data processing system derives a fluid loss rate or fluid gain rate based at least in part on changes in said position as a function of time.

20. The system of claim 18, wherein the acoustic signature contrasts are created by changes in at least one of: acoustic attenuation, acoustic coupling, resonance frequency, resonance damping, and active noise generation.

* * * * *